US007866296B2

(12) United States Patent
Schapiro

(10) Patent No.: US 7,866,296 B2
(45) Date of Patent: Jan. 11, 2011

(54) ROTARY PISTON MACHINE WITH AN OVAL ROTARY PISTON

(75) Inventor: Boris Schapiro, Berlin (DE)

(73) Assignee: RKM-Rotationskolbenmaschinen GBR, Berlin (DE)

( * ) Notice: Subject to any disclaimer, the term of this patent is extended or adjusted under 35 U.S.C. 154(b) by 205 days.

(21) Appl. No.: 11/544,461

(22) Filed: Oct. 6, 2006

(65) Prior Publication Data

US 2007/0089701 A1 Apr. 26, 2007

Related U.S. Application Data

(63) Continuation-in-part of application No. 11/212,496, filed on Aug. 26, 2005, now Pat. No. 7,117,840, which is a continuation of application No. PCT/EP2004/001921, filed on Feb. 26, 2004.

(30) Foreign Application Priority Data

Feb. 27, 2003 (DE) ..... 103 08 831

(51) Int. Cl.
*F02B 53/00* (2006.01)

(52) U.S. Cl. ..... 123/204; 123/209

(58) Field of Classification Search ..... None
See application file for complete search history.

(56) References Cited

U.S. PATENT DOCUMENTS

| | | | | |
|---|---|---|---|---|
| 3,117,563 A | | 1/1964 | Wiegert | |
| 3,760,777 A | | 9/1973 | Leroy | |
| 4,218,992 A | * | 8/1980 | Latsch et al. | 123/263 |
| 4,332,224 A | * | 6/1982 | Latsch et al. | 123/254 |
| 4,442,807 A | * | 4/1984 | Latsch et al. | 123/263 |
| 4,513,708 A | * | 4/1985 | Latsch et al. | 123/263 |
| 5,024,193 A | * | 6/1991 | Graze, Jr. | 123/259 |
| 5,105,780 A | * | 4/1992 | Richardson | 123/263 |
| 5,392,744 A | * | 2/1995 | Regueiro | 123/262 |
| 5,522,357 A | * | 6/1996 | Nogi et al. | 123/261 |
| 6,073,605 A | * | 6/2000 | Matsuoka et al. | 123/292 |
| 6,539,913 B1 | * | 4/2003 | Gardiner | 123/231 |

FOREIGN PATENT DOCUMENTS

| | | |
|---|---|---|
| DE | 28 53 930 A | 12/1978 |
| FR | 1 327 607 A | 12/1963 |
| JP | 53 028810 A | 3/1978 |
| LU | 45663 A | 3/1964 |

* cited by examiner

*Primary Examiner*—Thomas Denion
*Assistant Examiner*—Douglas J. Duff
(74) *Attorney, Agent, or Firm*—Lawrence G. Fridman

(57) ABSTRACT

An internal combustion engine having at least one working chamber limited by a piston and means for fuel injection, wherein said fuel injection means are arranged in a separate ignition chamber communicating with said working chamber, and means for tuning said ignition chamber and fuel injected by said fuel injection means such that substantially only burnt, expanding combustion gas enters the working chamber.

9 Claims, 10 Drawing Sheets

ROTARY PISTON MACHINE WITH AN OVAL ROTARY PISTON

THIS IS A CONTINUATION-IN-PART APPLICATION OF CURRENTLY U.S. patent application Ser. No. 11/212,496 FILED Aug. 26, 2005, now U.S. Pat. No. 7,117,840 WHICH IS A CONTINUATION OF INTERNATIONAL APPLICATION NO. PCT/EP2004/001921 FILED Feb. 26, 2004 WHICH CLAIMS PRIORITY OF GERMAN PATENT APPLICATION NO. 103 08 831.8 FILED Feb. 27, 2003.

FIELD OF THE INVENTION

The invention relates to an internal combustion engine having at least one working chamber limited by a piston and means for fuel injection.

BACKGROUND OF THE INVENTION

Combustion Engines with pre-combustion chambers are known from various prior art patents and other publications, such as AT 196669 E; AU 4634597A; AU 725961B; BR 9712894 A; CA 2271016 A1; CA 2271016 A; CH 691401 A; DE 69703215 T2; EP 937196 B1.

However, the known pre-combustion chamber has not been successfully commercialized. Many experiments have shown, that the pre-combustion chamber causes an increase of the efficiency of the combustion engines. This is only possible up to a rotary frequency of the shaft up to about 3000 $min^{-1}$. Conventional pre-combustion chambers operated at higher frequencies cause a considerable decrease of the efficiency and a poor quality of the exhaust gases. The reason for this bad performance is the transport of the burnt fuel from the pre-combustion chamber to the main combustion chamber through a narrow passage requiring a time interval of more than 20 ms.

Schapiro-Engines are known with a different design of a rotational piston engine. This new kind of engine may operate with a considerably different rotational speed of the rotational piston and the shaft. Depending on the design of the engine the piston of such engines may, for example, rotate three to seven times slower than the shaft. Accordingly, the admissible time for transport of the gases combusted in the pre-combustion chamber into the primary combustion chamber is three to seven times longer in such engines.

Therefore, the critical limit for the rotational frequency of the shaft of a rotational piston engine with a pre-combustion chamber may be in the order of 9000 to 20000 $min^{-1}$.

SUMMARY OF THE INVENTION

It is an object of the invention to provide a combustion engine with internal combustion and an increased efficiency. According to the invention this object is achieved in that fuel injection means are arranged in a separate ignition chamber communicating with said working chamber, and means for tuning said ignition chamber and fuel injected by said fuel injection means such that substantially only burnt, expanding combustion gas enters the working chamber.

Conventional pre-combustion chambers serve the purpose of producing turbulences and heating the fuel. They do not intend to separate the operating method of a combustion engine in an essentially separated combusting and working process.

Such a separation is the main intention of the present invention. The main differences of the invention with respect to the prior art can be summarized as follows:

While the form of known pre-combustion chambers is similar to a canal to produce turbulences along the longer path and to complete the combustion as much as possible the present invention seeks to optimize the form of the ignition chamber to effect the best possible combustion by optimizing the surface/volume-ratio.

The direction of the movement of the flame front of prior art designs corresponds to the direction of the torch of the injection nozzle towards the main combustion chamber. In such a construction the fuel must be combusted along the torch in order to achieve a good combustion ratio when entering into the working chamber.

Depending on the power the transporting of the combusted gas requires a time of about 20 to 30 ms. This is caused by the combustion kinetics and catalytic after-burning processes during passage of the grating or net in the transition passage. Conventional reciprocating piston engines do not allow for such times in the high power working range. The new rotational piston engines, however, allow such transition times because the piston of the rotational piston engines of the Schapiro-kind rotate three to seven times slower than the shaft. If, for example, the piston rotates five times slower than the shaft, rotational frequencies of about 15000 $min^{-1}$ are well possible.

Although the invention will be described with a Schapiro-Engine with two shafts, the person skilled in the art will appreciate, that an injection device disposed within the pre-combustion chamber in the above described way will also be useful in engines of other kinds, with for example one shaft, and that the scope of the present invention is limited only by the appending claim.

Embodiments of the invention are described hereinbelow with reference to the accompanying drawings.

DESCRIPTION OF THE EMBODIMENTS OF THE INVENTION

Figure 1:
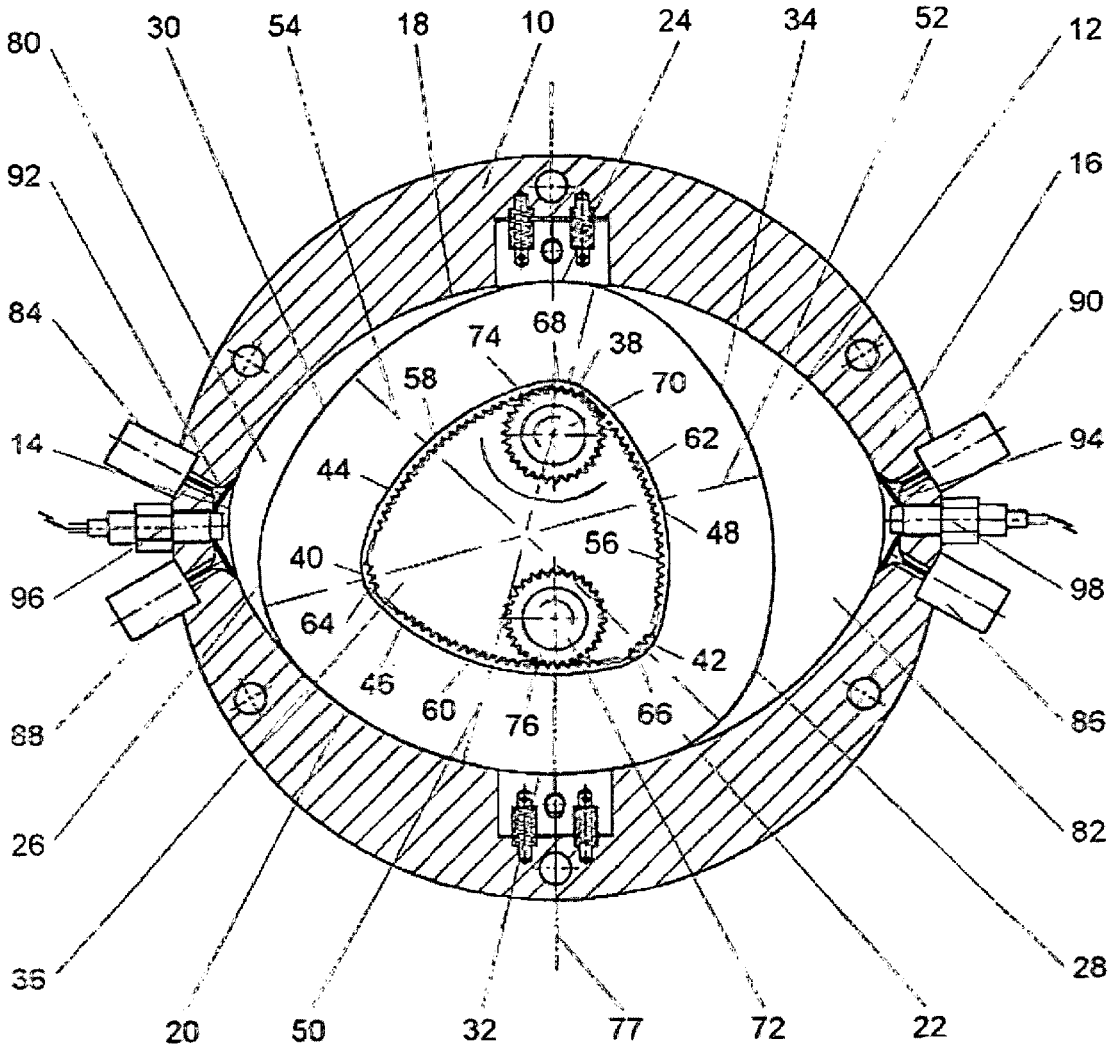
FIG. 1 shows a cross sectional view of a rotary piston machine having two shafts, wherein a rotary piston, the cross section of which is an oval of third order, is guided in a cavity, the cross section of which is an oval of second order.

Referring to FIG. 1, numeral 10 designates a housing. A cavity 12 is defined in this housing 10. The cross section of the cavity represents an oval of second order or is "bi-oval". Thus the cross section of the cavity is formed by two circular arcs 14 and 16 of relatively small radius of curvature and, alternating therebetween, two circular arcs 18 and 20 of relatively large radius of curvature. The circular arcs join continuously and differentiably.

A rotary piston 22 is guided in cavity 12. The cross section of the rotary piston 22 represents an oval of third order or is "tri-oval". Accordingly, the circumference of the cross section consists of three pairs of circular arcs, each pair comprising a circular arc of relatively small radius of curvature 24, 26 and 28, respectively, and a circular arc of relatively large radius of curvature 30, 32 and 34, respectively. The circular arcs of small and large radii of curvature join alternatingly and also continuously and differentiably. The small radii of curvature of the rotary piston 22 are equal to the small radii of curvature of the cavity 12, and, in the same way, the large radii of curvature of the rotary piston 22 are equal to the large radii of curvature of the cavity 12. The cross section of the cavity 12 looks similar to an ellipse. The cross section of the rotary piston looks similar to a triangle of arcs with rounded corners.

The rotary piston 22 has a central aperture 36. The cross section of the aperture 36 represents also an oval of third order. This oval of third order is composed of three circular arcs of relatively small radii of curvature 38,40 and 42 and of three circular arcs of relatively large radii of curvature. The circular arcs 38, 40 and 42 having small radii of curvature and the circular arcs 44,46 and 48 having large radii of curvature join alternatingly and continuously and differentiably, whereby an oval similar to a triangle of arcs with rounded corners is formed. The planes of symmetry 50, 52 and 54 of the aperture 36 coincide with the planes of symmetry of the rotary piston 22.

The aperture 36 has an internal gear 56. This internal gear 56 has three concave-arcuate gear racks 58, 60 and 62 substantially along the circular arcs 44, 46 and 48, respectively. Between these concave-arcuate gear racks 58, 60 and 62, convex-arcuate (or straight) gear racks 64, 66 and 68 are provided in the region of the circular arcs of small radius of curvature.

Two parallel shafts 70 and 72 with pinions 74 and 76, respectively, extend through the aperture 36. The axes of the shaft are located in the plane of symmetry 77, extending through the circular arcs 18 and 20, of the cavity 12. The pinion of one shaft, in FIG. 1 the pinion 74 of shaft 70, is located in the "corner of the triangle of arcs", i.e. in the region of the circular arc 38 of small radius of curvature and meshes with the internal gear 56, as will be described below. The pinion of the other shaft, in FIG. 1 pinion 76 of shaft 72, meshes with the opposite concave-arcuate gear rack, in FIG. 1 the gear rack 60.

The rotary piston 22 subdivides the bi-oval cavity 12 into two working chambers 80 and 82. In FIG. 1, the rotary piston machine is illustrated schematically as an internal combustion engine. Accordingly, an inlet valve 84 or 86 and an outlet valve 88 or 90 is shown for each working chamber 80 and 82, respectively. Furthermore, a combustion chamber 92 or 94 with a spark plug or a fuel injector 98 and 98 communicates with each working chamber 80 and 82, respectively. The working chambers 80 and 82 with the valves and spark plugs or fuel injectors are arranged symmetrical to the plane of symmetry passing through the circular arcs 14 and 16 of small radii of curvature.

Pairs of adjacent sealing ledges 100A and 100B and 102A and 102B are provided in the regions 18 and 20, respectively, of large radii of curvature. The sealing ledges 100A and 100B and 102A and 102B, respectively, are symmetrical to the plane of symmetry passing through the circular arcs 18 and 20 of large radii of curvature of the cross section.

Figure 7A:
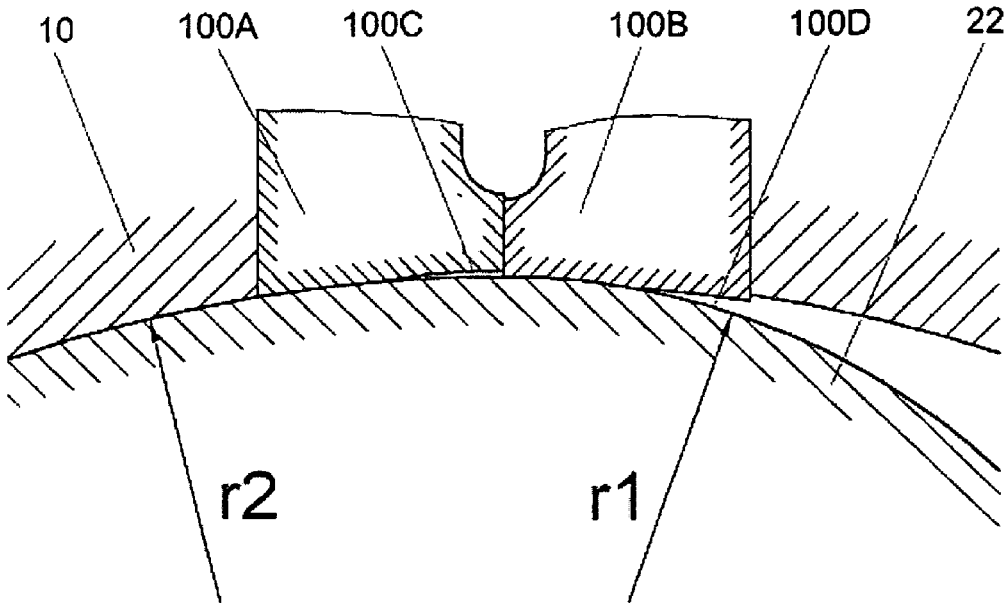
FIG. 7A is a schematic enlarged illustration of a seal used in a rotary piston machine of the type illustrated in FIGS. 1 to 5, sealing being effected between a sealing ledge and a surface section of the rotary piston having the smaller radius of curvature.

FIG. 7A shows the sealing ledges 100A and 100B with a position in the area of the transition from the small radius of curvature $r_1$ of the outer surface of the rotary piston 22, on the right in FIG. 7A, to the area of the larger radius of curvature $r_2$ of this outer surface, on the left in FIG. 7A. The sealing ledge 100A has a concave-cylindrical inner surface, the radius of curvature of which is equal to the larger radius of curvature $r_2$. The sealing ledge 100B has a concave-cylindrical inner surface, the radius of curvature of which corresponds to the smaller radius of curvature $r_1$. It will be apparent, that the inner surface of the sealing ledge 100A closely engages the surface of the rotary piston complementary thereto, in the area of the radius of curvature $r_2$. In the area, in which the radius of curvature of the surface of the rotary piston is smaller, namely $r_1$, a wedge-shaped gap 100C is formed between the inner surface of the sealing ledge 100A and the rotary piston 22. The sealing ledge 100B has a concave-cylindrical inner surface, the radius of curvature is equal to the smaller radius of curvature $r_1$. It will be apparent, that the inner surface of the sealing ledge 100B closely engages the surface of the rotary piston 22 complementary thereto, in the area of the radius of curvature $r_1$, of the rotary piston 22. In the area, in which the radius of curvature of the surface of the rotary piston 22 is larger, namely $r_2$, a wedge-shaped gap 100D is formed between the sealing ledge 100B and the rotary piston 22. In the transition region illustrated, both sealing ledges, on a respective portion of the inner surface, are in surface contact with the outer surface of the rotary piston, whereby a surface-to-surface seal is ensured.

Figure 7B:
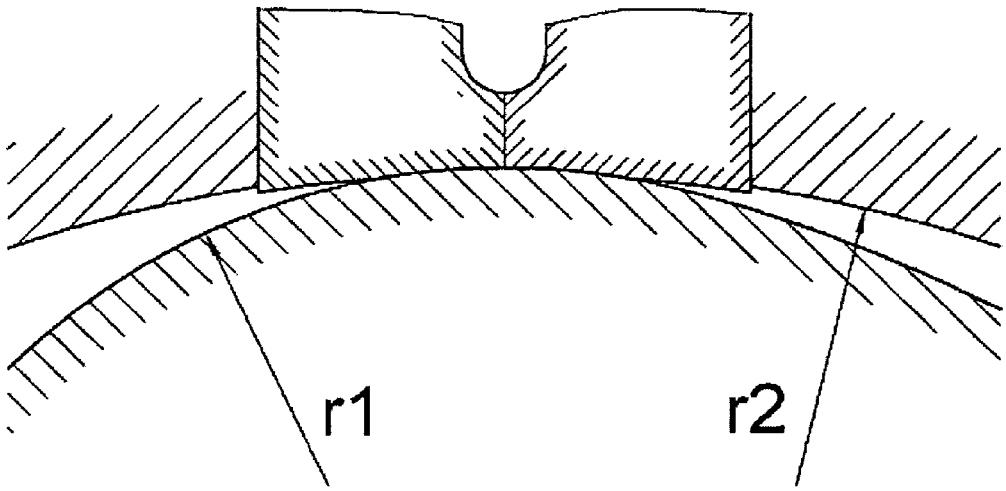
FIG. 7B is a schematic enlarged illustration of a seal used in a rotary piston machine of the type illustrated in FIGS. 1 to 5, sealing being effected between a sealing ledge and a surface section of the rotary piston having the larger radius of curvature.

FIG. 7B shows, in similar manner, the seal in the area of the transition from the large radius of curvature $r_2$ to the smaller radius of curvature $r_1$. When the pair of sealing ledges 100A and 100B engages an area of the rotary piston having large radius of curvature $r_2$ only or an area having small radius of curvature $r_1$, only, either the sealing ledge 100A or the sealing ledge 100B ensures a surface contact with its respective total inner surface.

The described arrangement operates in the following manner. The rotary piston 22 rotates counter-clockwise in FIG. 1. When doing so, the rotary piston 22 rotates about the shaft 70 and slides with low speed along the inner wall of the cavity 12 in the area of the large radius of curvature. The axis of the shaft 70 passes through the center of curvature of the circular arc 24 of smaller radius of curvature. The circular arc 24 is tangent to the circular arc 18 of the cross section of the cavity 12. The opposite area of the outer surface of the rotary piston 22 with large radius of curvature engages the area of the inner wall of the cavity 12 corresponding to the circular arc 20. This area of the inner wall has the same radius of curvature as the engaging area of the outer surface of the rotary piston. Thus, there is a shape-adapted surface-to surface engagement. During the rotary movement of the rotary piston, this area of the outer surface of the rotary piston slides along the corresponding area of the inner wall.

Thereby, the volume of the working chamber 80 is increased, while the volume of the working chamber 82 becomes smaller. During this process, the shaft 70 is rotated relatively slowly, while a relatively fast rotation of the shaft 72 occurs.

Figure 2:
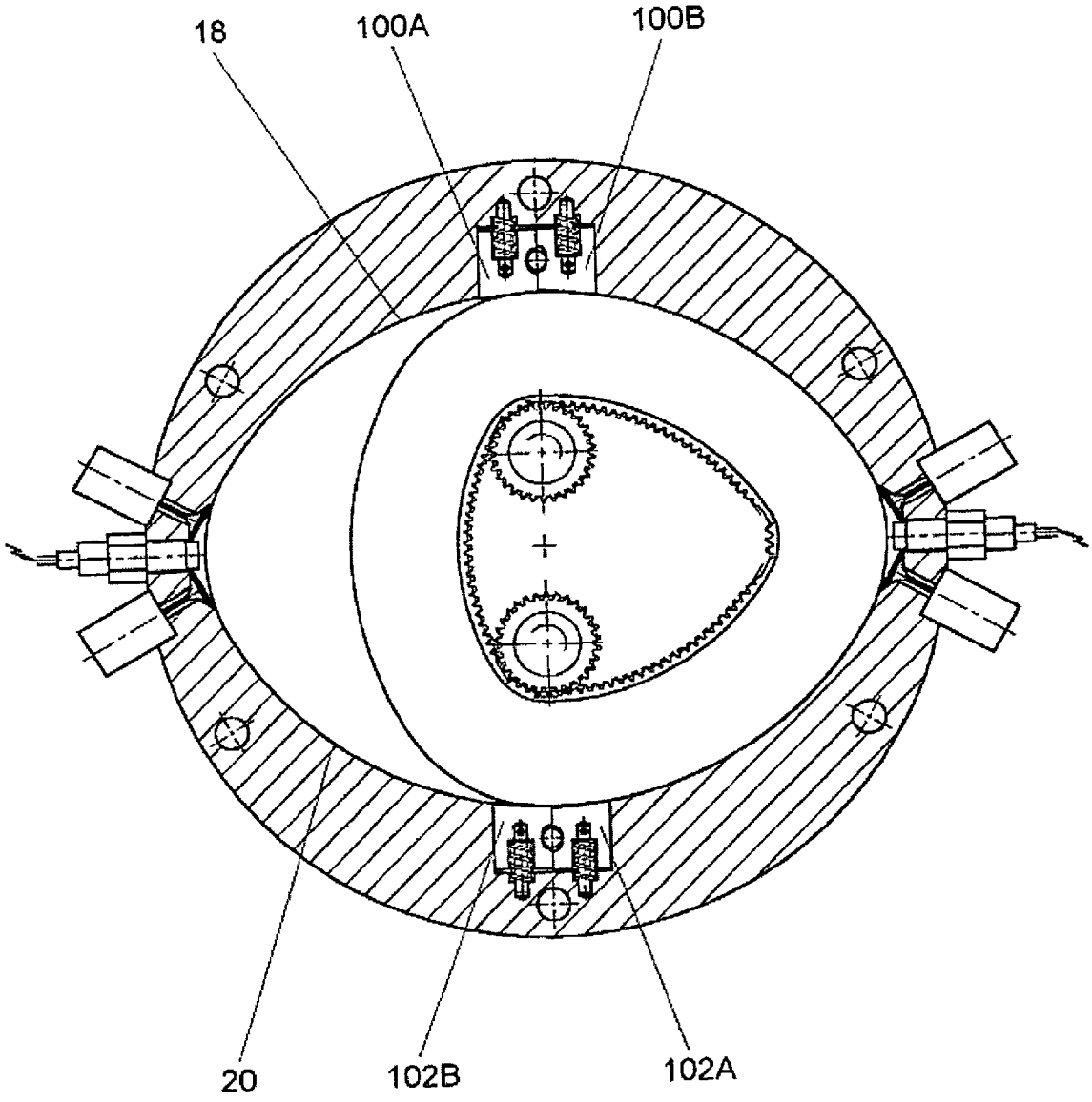
FIG. 2 is an illustration similar to FIG. 2 and shows the rotary piston in a blocking position.

This movement is continued, until the right blocking position in FIG. 2 is reached. Then the area of the outer surface of the rotary piston is located in that area of the inner wall of cavity 12, which corresponds to the circular arc 16. Both areas have the same, namely the small radius of curvature. The areas of the outer surface of the rotary piston corresponding to the circular arcs 32 and 34 having the large radius of curvature engage that areas of the inner wall of cavity 12, which correspond to the circular arcs 18 and 20, respectively, of the cross section. These radii of curvature, again, are equal. Thus the volume of the working chamber 82, apart from the combustion chamber 82, is reduced to zero, while the working chamber 82 has its maximum volume. Then the shaft 72 with the pinion 76 is located in the region which corresponds to the circular arc 40, thus, so to say, in the left lower "corner" of the triangle of arcs. The rotary piston 22 is, however, not able to further rotate about the shaft 70 as instantaneous axis of rotation. This position is illustrated in FIG. 2.

For a further rotation, which may, for example, be effected by igniting fuel in the combustion chamber 94 in an internal combustion engine or by conducting a working fluid into the working chamber 82, the instantaneous axis of rotation "jumps" to the axis of shaft 72. The rotary piston 22 can now continue to rotate counter-clockwise, but now about the shaft 72.

The further motion sequence is then, referenced to the new instantaneous axis of rotation, the same as described before with reference to the shaft 70 as instantaneous axis of rotation.

Figure 3:
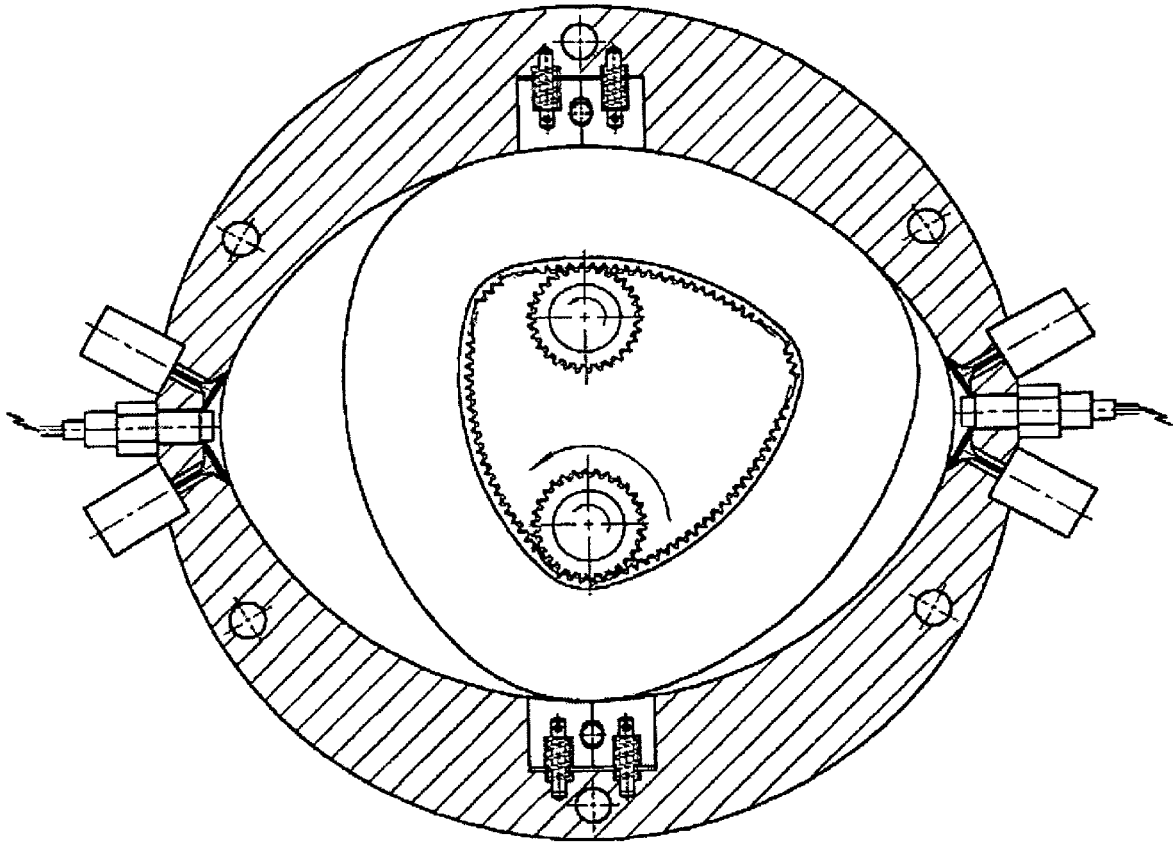
FIG. 3 is an illustration similar to FIG. 2 and shows the rotary piston during the next interval of motion.

Consecutive intervals of motion occur, when the rotary piston 22 rotates. Each interval of motion extends from one of the described blocking positions to the next one. In each interval of motion, the volume of one working chambers, for example 80, increases from zero to a maximum, while the volume of the other working chamber decreases from the maximum down to zero. During the next interval of motion, it is the other way round: The volume of the working chamber 82 increases from zero (FIG. 2) up to a maximum, while the volume of the working chamber 80 decreases again (FIG. 3).

In the position of FIG. 2, the kinematics is not unambiguous. Each of the two shafts could with its axis define an instantaneous axis of rotation. If then, for example, by working fluid conducted into the working chamber 82, a force to the left is exerted on the rotary piston 22, this force could result in a translatory motion in horizontal direction instead of a rotary motion about an instantaneous axis of rotation. Thereby, the rotary piston 22 would be wedged in the cavity 12.

This risk can be avoided in that, in the position of FIG. 2, rotary speed regulating means are used to temporarily compel a lower rotary speed of the shaft 72 than the rotary speed of shaft 70. Then the rotary piston is forced to rotate about this shaft 72, while the other shaft 70 permits the concave-arcuate gear rack to roll off on the pinion 74.

Figure 6:
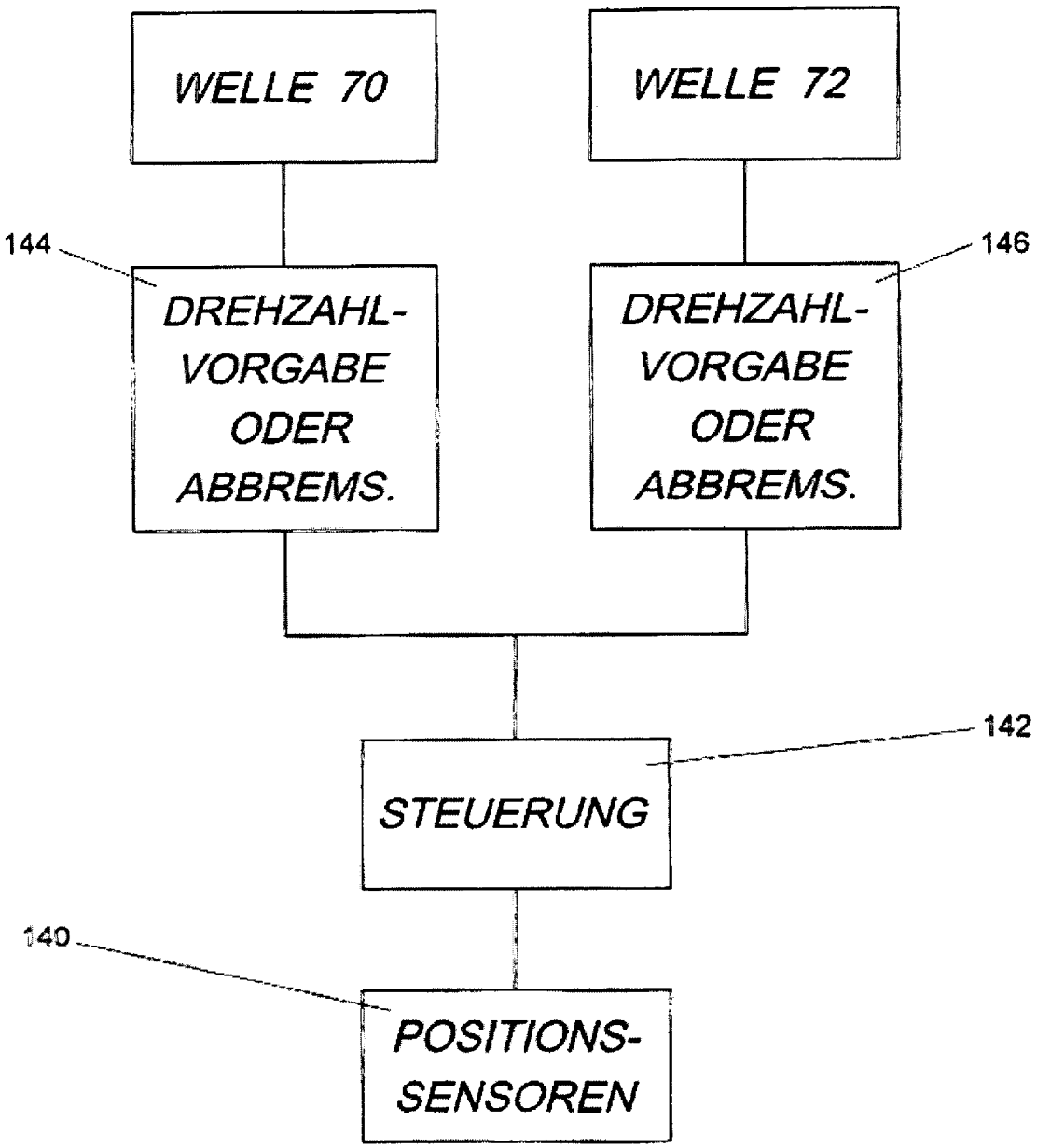
FIG. 6 is a schematic illustration of rotary speed regulating means used in a rotary piston machine of FIG. 1.

This is schematically illustrated in FIG. 6. Sensors 140 detect the position of the rotary piston 22 in the cavity 12. The sensors signal when the rotary piston has reached a blocking position. Then a control device 142, to which the signals from the sensors are applied, actuates devices 144 and 146 by which, alternatingly, depending on which blocking position had been reached, rotary speeds are temporarily, for a short time, rotary speeds are forced on shaft 70 or shaft 72, respectively, For example, a lower rotary speed is forced on shaft 70, and a higher rotary speed is forced on shaft 72 or vice versa. In the simplest case, these devices 144 and 146 may be braking devices which, in the blocking positions, are caused to act, alternatingly for a short time, on the shaft 70 or the shaft 72, while the respective other shaft remains unbraked.

The radii of the reference circles of the pinions are substantially equal to the small radii of curvature of the oval of second order defining the aperture 36. If the internal gear 56 followed the oval of the aperture continuously, then the pinions would be caught, each time, in the blocking positions of the rotary piston 22. The "corners" of the "triangle of arcs" could not roll over the pinions. For this reason, the concave-arcuate gear racks are interconnected, in the region of the circular arcs 38, 40, 42 of smaller radii of curvature, are interconnected by short straight or convex-arcuate gear racks 64, 66 or 68, respectively. The convex-arcuate gear racks 64, 66 and 68 permit the internal gear 56, and thereby the rotary piston 22, to continue its rotation. They are so dimensioned that, in each blocking position, one of the concave-arcuate gear racks 58, 60 or 62 engages the pinion 74 or 76 immediately after the pinion 74 or 76 has disengaged the preceding gear rack 62, 58 or 60, respectively. In this way, each pinion continuously engages one of the concave-arcuate gear racks 64, 66 or 68. The short convex-arcuate or straight gear racks ensure transition without interrupting the form fit but also without blocking.

Figure 4:
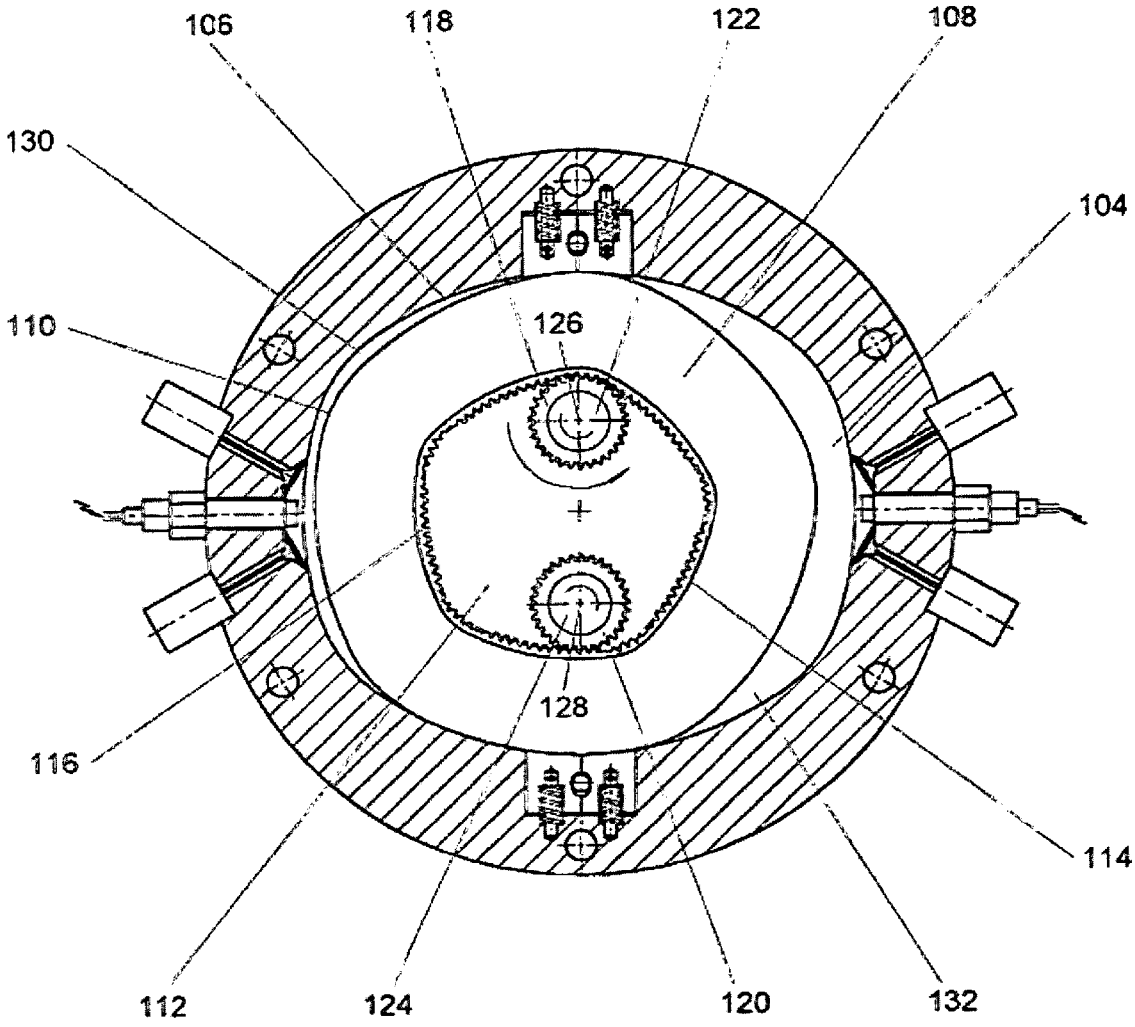
FIG. 4 shows a cross sectional view of a rotary piston machine having two shafts, wherein the rotary piston, the cross section of which is an oval of fifth order, is guided in a cavity, the cross section of which is an oval of fourth order.

FIG. 4 shows a rotary piston machine having a cavity, the cross section of which represents an oval 106 of fourth order. A rotary piston 108, the cross section of which represents an oval 110 of fifth order is guided in the cavity 108. Also here, the rotary piston 108 has an aperture 112, the shape of which represents an oval 114 of fifth order. The axes of symmetry of rotary piston 108 and aperture coincide. The aperture has an internal gear 116. The internal gear 116 meshes with two pinions 118 and 120. The pinions 118 and 120 are attached to two housing-fixed shafts 122 and 124, respectively. The axes 126 and 128 of the shafts 122 and 124, respectively extend in an axis of symmetry of the cavity 104.

The rotary piston 108 subdivides the cavity into two working chambers 130 and 132. When the rotary piston rotates, the volume of one of such working chambers is increased and the volume of the other chamber is decreased.

The operating cycle is similar to the operating cycle of the embodiment of FIGS. 1 to 3. The rotary piston 108 rotates, for example, about the axis 126 of one shaft 122 up to a blocking position. Then the instantaneous axis of rotation jumps into the axis 128 of the other shaft 124. The rotary piston continues to rotate counter-clockwise in FIG. 4 up to the next blocking position. Course of motion between two consecutive blocking positions is an "interval of motion". In each interval of motion, the volume of the working chamber 130 increases from zero to a maximum and the volume of the working chamber 132 decreases from a maximum to zero, or vice versa. The working chambers are located always on both sides of the plane of symmetry containing the axes 126 and 128. They do not travel around the cavity.

In FIG. 4, valves and spark plugs or fuel injectors are (schematically) shown for each working chamber.

Figure 4A:
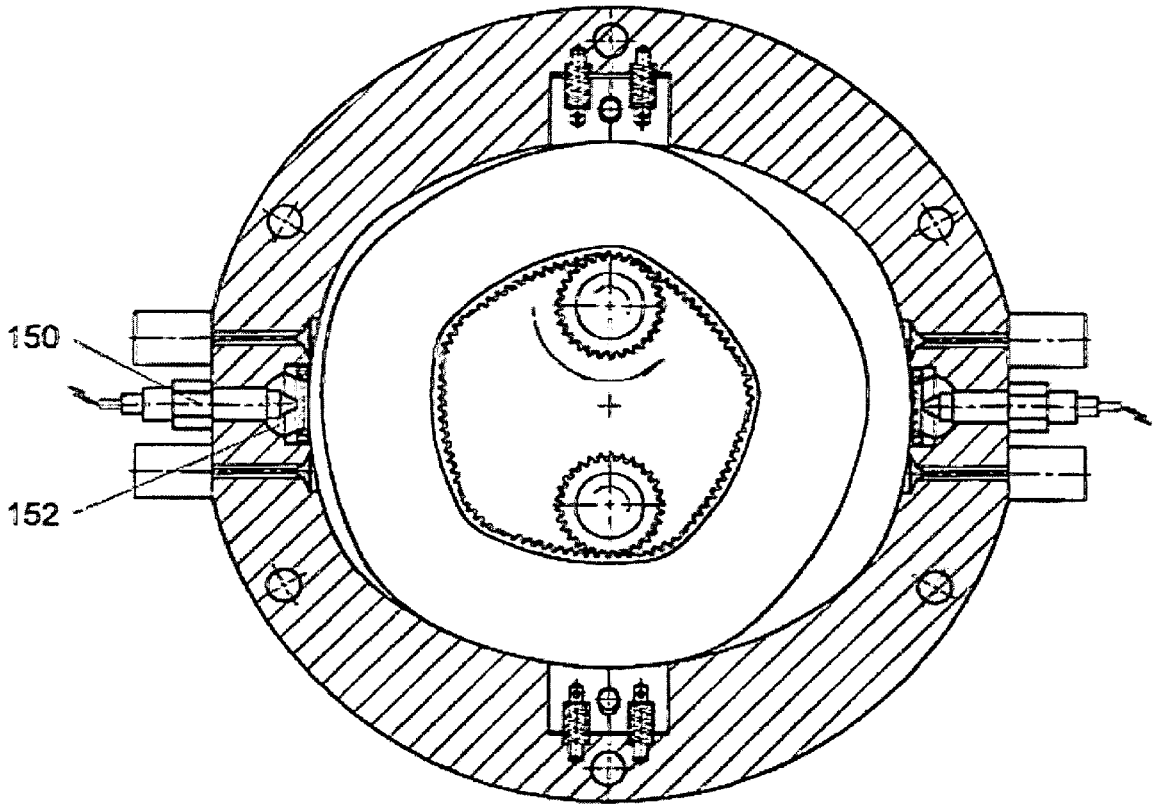
FIG. 4A shows a modification of the arrangement of FIG. 4.

FIG. 4A shows a rotary piston machine similar to FIG. 4. Corresponding elements bear the same reference numerals as there. Details of the rotary piston machine of FIG. 4A are shown, at an enlarged scale, in FIGS. 8 and 8A.

In the rotary piston machine of FIG. 4A, numeral 150 designates a fuel injector. The fuel injector extends into a combustion chamber. This combustion chamber is so dimensioned and shaped, that the injected fuel is combusted substantially in the combustion chamber only. Then only the expanding combustion gases emerge into the expanding working chamber. The injection may be metered time-dependent or dependent on the rotation of the rotary piston such that it is adapted to the change of volume of the working chamber 130 or 132. There is no flame front within the working chamber. The propagation of flame fronts in an expanding working chamber presents problems in prior art rotary piston machines.

Figure 8:
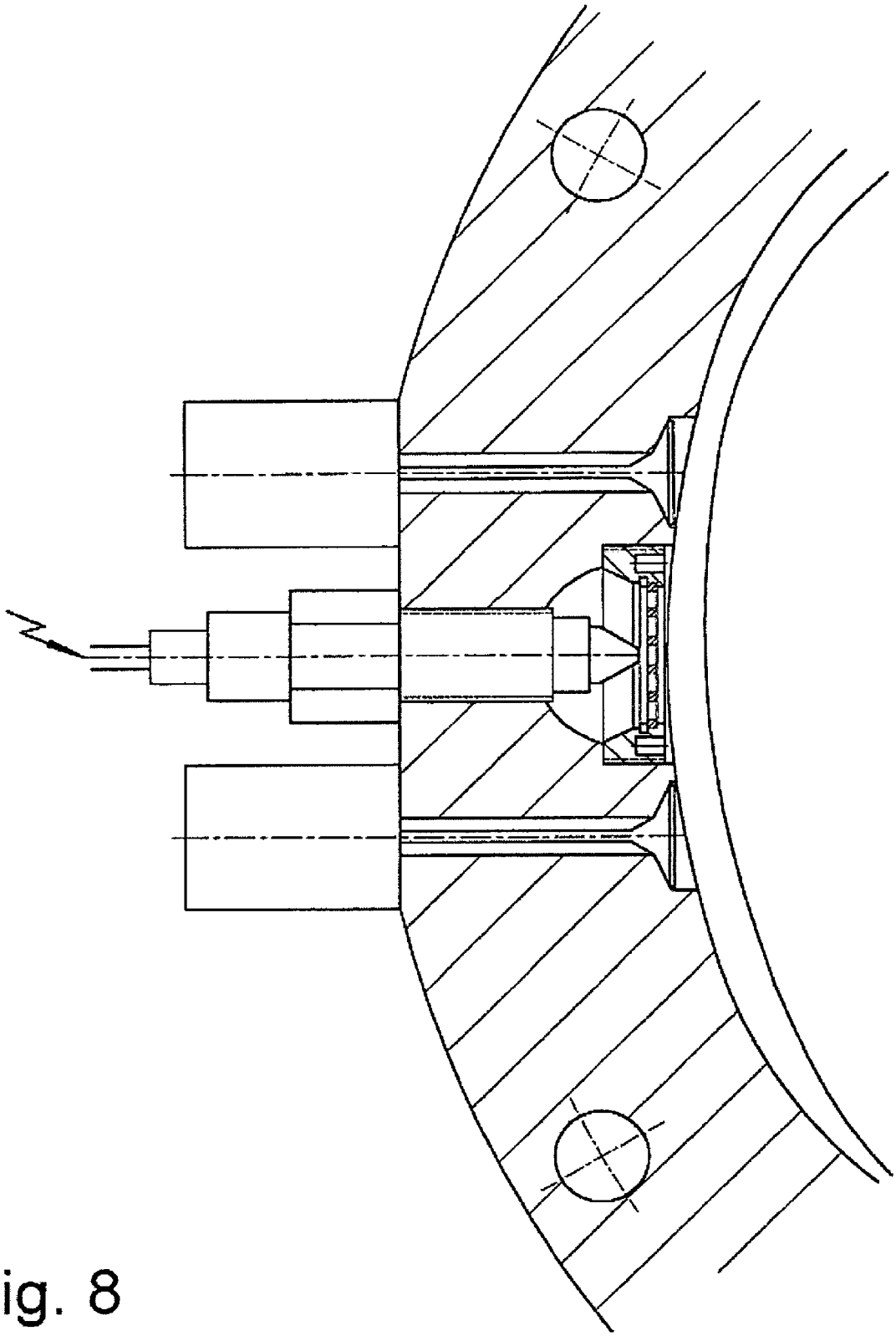
FIG. 8 shows, at an enlarged scale, a detail of the rotary piston machine of FIG. 4A.
Figure 8A:
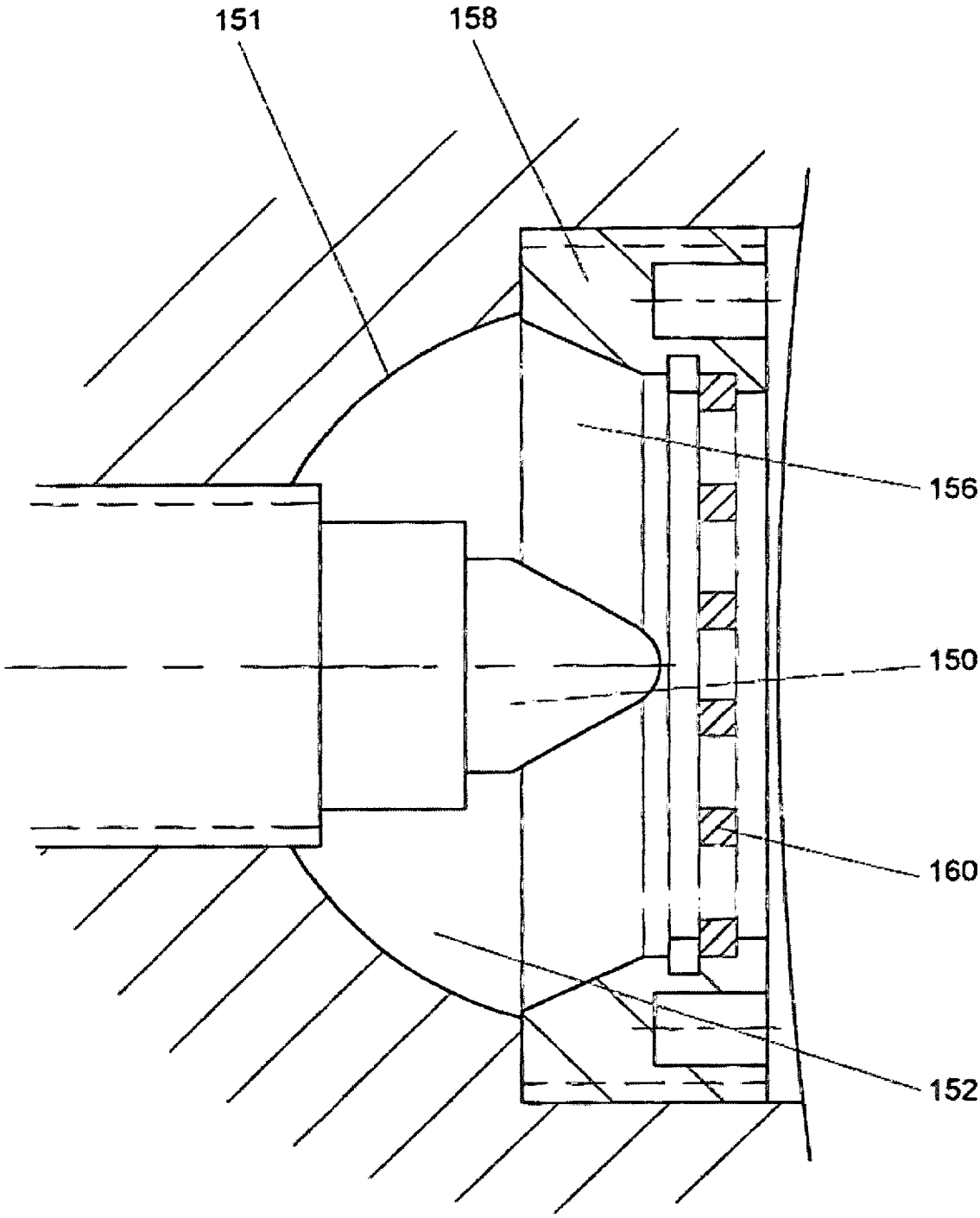
FIG. 8A shows the detail of FIG. 8 at a further enlarged scale.

In the embodiment of FIGS. 8 and 8A, the combustion chamber comprises a spherical calotte-shaped recess of the housing, which communicates with a frustro conical space 156 tapering towards the working chamber. The space 156 is formed in an insert 158, which is screwed in a threaded recess of the wall of the working chamber 130 or 132. The combustion chamber 152 is closed by a grid or net 160. The fuel injector 150 terminates in a cone rounded at the tip, injection taking place through nozzle openings in the surface of this cone.

The described arrangement of the fuel injector in a combustion chamber such that combustion takes place substantially within the combustion chamber and flame fronts in the working chambers are avoided, is also applicable to other machines, for example in reciprocating internal combustion engines.

Figure 5:
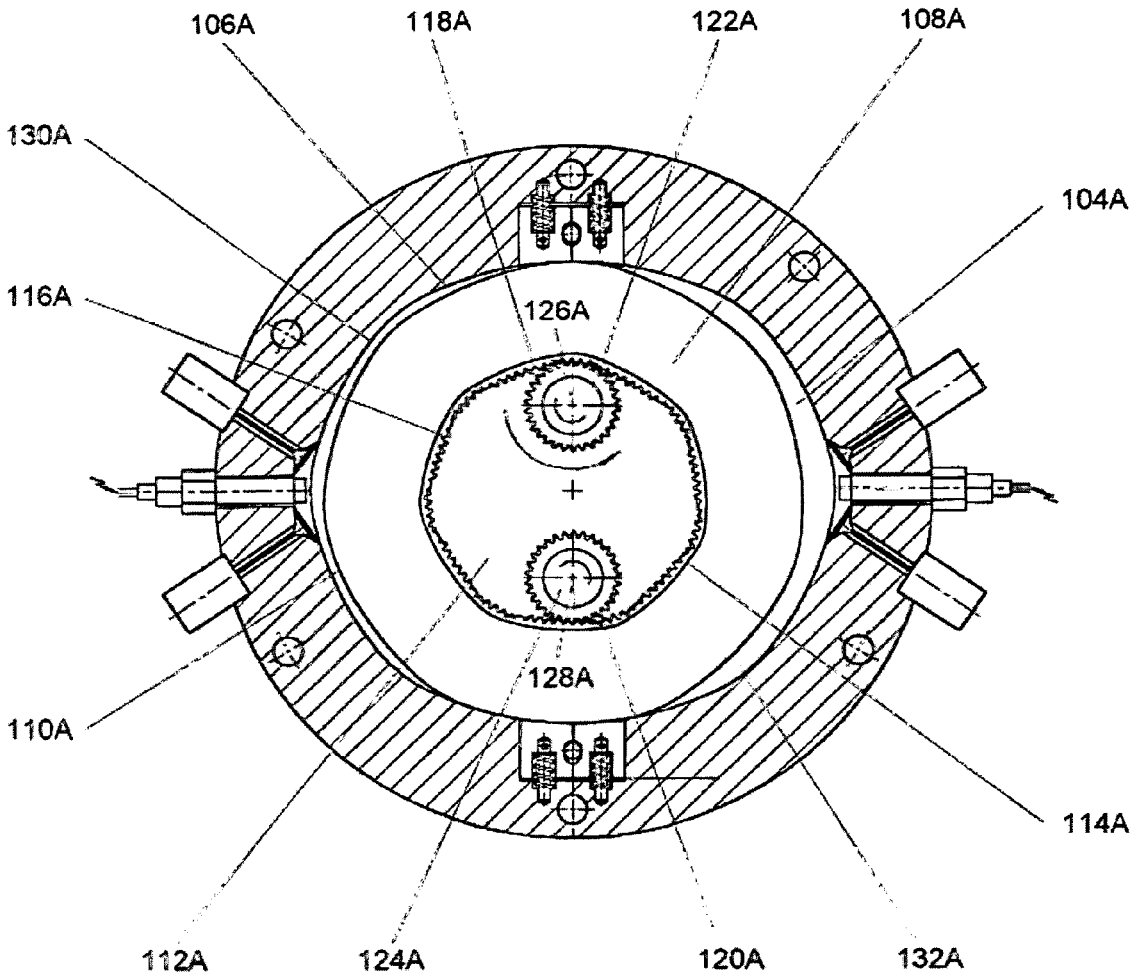
FIG. 5 shows a cross sectional view of a rotary piston machine having two shafts, wherein a rotary piston, the cross section of which is an oval of seventh order, is guided in a cavity, the cross section of which is an oval of sixth order.

FIG. 5 shows a rotary piston machine, wherein a rotary piston, the cross section of which represents an oval of seventh order, is guided in a cavity the cross section of which represents an oval sixth order. Setup and operation are, apart from the orders of the ovals, similar to that of the embodiment of FIG. 4. Corresponding elements are designated by the same reference numerals as in FIG. 4, however marked by the suffix "A".

What is claimed is:

1. An internal combustion engine comprising:

at least one working chamber formed by a rotary piston and fuel injection means, said fuel injection means being arranged in a separate ignition chamber communicating with said working chamber through a transition passage, said transmission passage comprises a grid-type formation arranged between the ignition chamber and the working chamber, said fuel injection means injects a fuel through the transmission passage into the ignition chamber; and the fuel injector means extends into a combustion chamber, said combustion chamber is configured so that the injected fuel is combusted only in the combustion chamber, so that a flame front resulted from said combustion is initiated in the combustion chamber, and said flame front with resulting torch-like flames and flame plumes do not extend into the transition passage and into the working chamber, wherein the fuel injector means and the rotary piston are fluidly connected at all times.

2. An internal combustion engine according to claim 1; wherein said fuel ignition means injects the fuel at the transmission passage into the ignition chamber.

3. An internal combustion engine according to claim 1; wherein said grid type formation connects the ignition chamber with the working chamber.

4. An internal combustion engine according to claim 2, wherein the ignition chamber comprises a substantially spherical recess formed within a housing of the engine, said recess communicating with a frustro conical space tapering in the direction of the working chamber, said frustro conical space forms a part of an insert operatively engaging a wall of the working chamber, a grid-type formation is disposed within said insert at an interface between the ignition chamber and the working chamber.

5. An internal combustion engine according to claim 4, wherein. said insert is adapted to threadably engage a recess formed within the wall of the working chamber.

6. An internal combustion engine according to claim 5, wherein said grid-type formation is in a form of a net.

7. An internal combustion engine according to claim 1; wherein the ignition chamber comprises a substantially spherical recess formed within a housing of the engine, said recess communicating with a frustro conical space tapering in the direction of the working chamber, said frustro conical space forming a part of an insert operatively engaging a wall of the working chamber, the grid-type formation is disposed within said insert at an interface between the ignition chamber and the working chamber.

8. An internal combustion engine according to claim 7, wherein said insert is adapted for threadable engagement with a recess formed within the wall of the working chamber.

9. An internal combustion engine according to claim 8, wherein said grid-type formation is in a form of a net.

* * * * *